US007585555B2

(12) United States Patent
Stroppiana

(10) Patent No.: US 7,585,555 B2
(45) Date of Patent: Sep. 8, 2009

(54) SYNTHETIC-GRASS FLOORING AND METHOD FOR LAYING SAME

(75) Inventor: Fernando Stroppiana, Grinzane Cavour (IT)

(73) Assignee: Mondo S.p.A., Alba Frazione Gallo (Cuneo) (IT)

( * ) Notice: Subject to any disclaimer, the term of this patent is extended or adjusted under 35 U.S.C. 154(b) by 313 days.

(21) Appl. No.: 11/614,497

(22) Filed: Dec. 21, 2006

(65) Prior Publication Data

US 2007/0148398 A1 Jun. 28, 2007

(30) Foreign Application Priority Data

Dec. 23, 2005 (EP) ..... 05425915

(51) Int. Cl.
*B32B 33/00* (2006.01)
*E02B 13/00* (2006.01)
*E04B 5/32* (2006.01)

(52) U.S. Cl. ..... 428/95; 428/17; 428/87; 428/68; 405/36; 405/38; 52/741.11; 52/747.1; 52/748.1

(58) Field of Classification Search ..... 428/17, 428/95, 87, 68, 76, 323; 273/DIG. 13; 405/36, 405/38, 43; 472/92, 94; 52/741.11, 747.1, 52/748.1, 169.1, 518, 578, 581
See application file for complete search history.

(56) References Cited

U.S. PATENT DOCUMENTS

RE4,066 E * 7/1870 Chipman ..... 428/177
157,851 A * 12/1874 Mayall ..... 428/54
3,731,923 A 5/1973 Greene ..... 272/56.5
4,337,283 A 6/1982 Haas, Jr. ..... 428/17
4,389,435 A * 6/1983 Haas, Jr. ..... 428/17
4,564,310 A * 1/1986 Thelen et al. ..... 404/31
5,647,689 A 7/1997 Gunter ..... 405/36
5,714,263 A * 2/1998 Jakubisin et al. ..... 428/407

(Continued)

FOREIGN PATENT DOCUMENTS

DE 44 44 030 10/1995

(Continued)

OTHER PUBLICATIONS

European Search Report from EP 05425915.5, dated Jun. 7, 2006.

*Primary Examiner*—Cheryl Juska
(74) *Attorney, Agent, or Firm*—Heslin Rothenberg Farley & Mesiti P.C.; Victor A. Cardona

(57) ABSTRACT

A flooring, for example for pitches for soccer, five-a-side football, American football, rugby, etc. which includes a polyolefin-based impermeable layer and an elastic mattress laid on top of the impermeable layer which includes a core layer having an agglomerate granular material and an envelope that envelops the core layer. A structure of synthetic-grass covering is laid on top of the elastic mattress and includes a sheetlike substrate with a plurality of filiform formations extending from the substrate to simulate the grassy sward of natural turf, as well as a particulate filling material or infill dispersed between the filiform formations to maintain the filiform formations themselves in a substantially upright condition. The flooring is suited to being laid directly on the previously flattened laying foundation so as to bestow a camber thereon to facilitate draining, such as a pitched camber.

43 Claims, 3 Drawing Sheets

U.S. PATENT DOCUMENTS

| | | | | |
|---|---|---|---|---|
| 5,958,527 | A | 9/1999 | Prevost | 428/17 |
| 5,961,389 | A | 10/1999 | Dickinson | 472/92 |
| 5,976,645 | A | 11/1999 | Daluise et al. | 428/17 |
| 6,221,445 | B1 * | 4/2001 | Jones | 428/17 |
| 6,299,959 | B1 * | 10/2001 | Squires et al. | 428/87 |
| 6,472,041 | B1 * | 10/2002 | Burke | 428/86 |
| 6,616,542 | B1 * | 9/2003 | Reddick | 473/171 |
| 6,620,482 | B2 * | 9/2003 | Carr et al. | 428/87 |
| 6,623,840 | B2 * | 9/2003 | Hainbach | 428/172 |
| 6,794,007 | B2 * | 9/2004 | Carr et al. | 428/87 |
| 6,796,096 | B1 * | 9/2004 | Heath | 52/403.1 |
| 6,858,272 | B2 * | 2/2005 | Squires | 428/17 |
| 6,877,932 | B2 * | 4/2005 | Prevost | 405/38 |
| 6,887,535 | B2 | 5/2005 | Stroppiana | 428/17 |
| 6,920,723 | B2 * | 7/2005 | Downey | 52/144 |
| 6,951,670 | B2 | 10/2005 | Stroppiana | 428/17 |
| 6,966,841 | B1 * | 11/2005 | Sherman | 472/89 |
| 7,014,390 | B1 * | 3/2006 | Morris | 405/50 |
| 7,144,609 | B2 * | 12/2006 | Reddick | 428/17 |
| 7,175,362 | B2 * | 2/2007 | Carr et al. | 404/17 |
| 7,186,450 | B2 * | 3/2007 | Foxon | 428/86 |
| 7,189,445 | B2 * | 3/2007 | Knox | 428/87 |
| 7,279,212 | B2 * | 10/2007 | Foxon | 428/95 |
| 7,361,401 | B2 * | 4/2008 | Desai et al. | 428/327 |
| 7,452,433 | B2 * | 11/2008 | Shin et al. | 156/71 |
| 2001/0046589 | A1 * | 11/2001 | Stroppiana | 428/150 |
| 2002/0119291 | A1 * | 8/2002 | Hainbach | 428/172 |
| 2002/0132099 | A1 | 9/2002 | Squires | 428/220 |
| 2003/0106949 | A1 * | 6/2003 | Stroppiana | 241/24.18 |
| 2004/0033322 | A1 * | 2/2004 | Stroppiana | 428/17 |
| 2004/0037975 | A1 * | 2/2004 | Stroppiana | 428/15 |
| 2004/0048225 | A1 * | 3/2004 | Fletcher | 433/76 |
| 2005/0003193 | A1 * | 1/2005 | Stroppiana | 428/407 |
| 2005/0129906 | A1 * | 6/2005 | Knox | 428/95 |
| 2006/0016635 | A1 * | 1/2006 | Downey | 181/290 |
| 2006/0084513 | A1 * | 4/2006 | De Vries et al. | 472/92 |
| 2006/0105847 | A1 * | 5/2006 | Stroppiana | 472/85 |
| 2006/0147670 | A1 * | 7/2006 | Reddick | 428/86 |
| 2006/0269703 | A1 * | 11/2006 | Stroppiana | 428/34.1 |
| 2007/0074486 | A1 * | 4/2007 | Stroppiana | 52/782.1 |
| 2007/0137017 | A1 * | 6/2007 | Knox | 29/428 |
| 2007/0148398 | A1 * | 6/2007 | Stroppiana | 428/95 |
| 2007/0154661 | A1 * | 7/2007 | Stroppiana | 428/21 |
| 2008/0015038 | A1 * | 1/2008 | Van Reijen | 472/92 |
| 2008/0044559 | A1 * | 2/2008 | Noh et al. | 427/145 |
| 2008/0044598 | A1 * | 2/2008 | Stroppiana | 428/17 |
| 2008/0236097 | A1 * | 10/2008 | Tinianov | 52/787.11 |
| 2009/0011152 | A1 * | 1/2009 | Stroppiana | 428/17 |

FOREIGN PATENT DOCUMENTS

| | | | |
|---|---|---|---|
| DE | 4444030 | A1 * | 10/1995 |
| DE | 195 21 944 | | 12/1995 |
| DE | 19521944 | A1 * | 12/1995 |
| EP | 377 925 | | 7/1990 |
| EP | 1 158 099 | | 11/2001 |
| EP | 1 319 753 | | 6/2003 |
| EP | 1 371 779 | | 12/2003 |
| EP | 1 375 750 | | 1/2004 |
| EP | 1 486 613 | | 12/2004 |
| EP | 1 555 097 | | 7/2005 |
| EP | 1555097 | A1 * | 7/2005 |
| JP | 10037122 | | 2/1998 |
| JP | 3253204 | | 4/2002 |
| WO | WO 9929963 | A1 * | 6/1999 |
| WO | WO 0209825 | A1 * | 2/2002 |
| WO | WO 2005/019533 | | 3/2005 |

* cited by examiner

SYNTHETIC-GRASS FLOORING AND METHOD FOR LAYING SAME

CROSS-REFERENCE TO RELATED APPLICATIONS

This application claims priority from European Patent Application No. 05425915.5, filed on Dec. 23, 2005, the entire disclosure of which is incorporated herein by reference.

This application contains subject matter which is related to the subject matter of co-owned U.S. patent application Ser. No. 11/616,979, filed Dec. 28, 2006, by Fernando Stroppiana, entitled "A YARN FOR PRODUCING SYNTHETIC GRASS, CORRESPONDING METHOD OF PRODUCTION, AND SYNTHETIC GRASS STRUCTURE PRODUCED USING SUCH YARN," which is assigned to the same assignee, Mondo S.p.A., and which is hereby incorporated herein by reference in its entirety.

TECHNICAL FIELD OF THE INVENTION

The present invention relates to synthetic-grass floorings, i.e., floorings which use coverings of synthetic (or artificial) grass.

BACKGROUND OF THE INVENTION

Synthetic-grass coverings have been used for quite some time now, in particular to provide areas of greenery for urban decoration and similar amenities, for areas for bordering swimming-pools, and, in general, for replacing natural-grass cover in all those conditions where the laying and maintenance of a natural-grass cover may prove critical. The use of said synthetic-grass coverings has received new impulse in recent times in order to provide coverings for sports facilities, for example soccer pitches. The corresponding literature is extremely extensive, as is witnessed, at a patent level, by documents such as: U.S. Pat. Nos. 3,731,923, 4,337,283, 5,958,527, 5,961,389, 5,976,645, JP-B-32 53 204, JP-A-10037122, DE-A-44 44 030, EP-A-0 377 925 and U.S. Pat. No. 6,887,535 (to which there corresponds EP-A-1 158 099).

In particular, from the document mentioned last, which is filed in the name of the present applicant, a synthetic-grass structure is known, which comprises a sheet-like substrate with a plurality of filiform formations extending from the substrate for simulating the grassy sward of natural turf and a particulate filling material, or infill, dispersed between the filiform formations so as to keep the filiform formations themselves in a substantially upright condition. Specifically, the above synthetic-grass covering is characterized in that the particulate filling material (infill) is constituted by a substantially homogeneous mass of a granular material chosen in the group constituted by polyolefin-based materials and by vinyl polymer-based materials.

Further advantageous developments of the above solution are described in the documents Nos. EP-A-1 319 753, EP-A-1 375 750, EP-A-1 371 779, as well as EP-A-1 486 613, all of said documents being owned by the present applicant.

SUMMARY OF THE INVENTION

The purpose of the present invention is to improve even further said known solutions from various points of view, such as:

- provision of a sports field, such as for example a football pitch, in order to ensure the best possible playing conditions and safety features;

- maximum durability and guarantee over time of the entire system resulting from laying of the flooring;
- compatibility with the environment, in particular as regards low ecological impact of the methodology of application, and respect of current directives regarding the use of recycled products, without this adversely affecting the playing features;
- possibility of providing the flooring at contained costs, it being possible at the same time to lay a sports field made of synthetic grass, reducing the amount of work to be carried out on the existing foundations to the minimum;
- easy and fast installation, such as to guarantee uniformity of characteristics and performance features; and
- possibility of convenient replacement of the synthetic-grass cover, also in view of possible recycling.

According to the present invention, that object is achieved thanks to a flooring presenting the characteristics referred to specifically in the ensuing claims. The invention relates also to a corresponding laying method. The claims form an integral part of the disclosure provided herein in regard to the invention.

The solution described herein provides an innovative synthetic-grass covering, totally compatible with the environment, which can be produced for at least up to 70% using recycled raw materials, is capable of affording the best possible playing features, altogether similar to those afforded by natural-grass turf, and can be made at very contained costs.

The solution described herein enables laying of a field for sports activities made of synthetic grass, limiting the interventions on the existing foundations in so far as it only involves levelling of the ground according to the camber necessary for draining-off of any water.

The solution described herein makes available a system that can be installed in a convenient and fast way and that guarantees uniformity of characteristics and performance. The body part (mattress) of the flooring presents characteristics of long durability, whilst the synthetic-grass covering can be easily replaced and recycled at the end of its life cycle of approximately ten years. The system has been studied so that the top part can be removed and replaced, and hence it can be sold on a leasing basis or rented.

The solution described herein enables provision of a sports field made of synthetic grass that is able to meet, among other things, the following requirements:

- limitation of the civil works to be carried out on the existing foundations;
- laying of a soccer pitch presenting the best possible characteristics as regards playing conditions and safety;
- maximum durability and guarantee over time of the entire system;
- low ecological impact of the method of application;
- respect of current directives and standards as regards use of recycled products; and
- possibility of recycling the material used to make the field at the end of its life cycle, preventing burdensome costs for dismantling or disposal.

In particular, with the solution described herein it is no longer necessary to remove and carry away the surface soil of a pre-existing field that has to be dismantled and then replace it with quarry material. Such operations are costly and moreover create inconvenience to road traffic, as well as having a negative ecological impact.

The solution described herein exploits instead the capacity of a membrane provided with reliefs to enable draining-off of any water, which flows away towards the outside of the pitch, thus protecting the foundation from any infiltration of moisture and possible erosion, which could in time lead to yielding of the foundation and consequently of the pitch itself. Even in the event of heavy rainfall, the water is drained off outwards thanks both to the camber of the field itself and to the capacity of the membrane for enabling it to run off and then be collected by a simple draining system along the perimeter of the field.

In the currently preferred embodiment of the invention, the body part (mattress) of the flooring is of a "fine-tuned" type, and exploits a biomechanical concept of fine tuning, whereby it is able to adapt to the characteristics, for example, of a soccer pitch so as to achieve ideal levels of energy absorption and elastic efficiency. Added to this is the guarantee of a level of absorption of impact which safeguards the physical integrity and safety of the sportsmen using it. All these qualities give rise to a system capable of ensuring excellent characteristics of playing conditions, providing the maximum safety and guaranteeing its duration over time. The mattress in question is characterized by its excellent features of durability (approximately thirty years) and proves in practice indestructible in normal conditions of use.

The solution described herein enables use of a large amount (approximately 70% of the end product) of recycled material that is appropriately treated, processed, purified and regenerated so as meet EC standards.

For instance, considering the size of a normal soccer pitch, it may be stated that:

- in the elastic mattress in question it is possible to reuse approximately 7,000 tires, appropriately ground, coated, treated and encapsulated so as to not create any environmental contamination;
- in the various membranes it is possible to reuse approximately 42,000 plastic bottles appropriately ground, molten and transformed;
- it is moreover possible to use an amount of product deriving from differentiated collection equal to approximately four complete lorry-loads of material, appropriately treated and transformed.

BRIEF DESCRIPTION OF THE DRAWINGS

The invention will now be described, purely by way of non-limiting example, with reference to the annexed plate of drawings, in which.

DETAILED DESCRIPTION OF THE DRAWINGS

Figure 1:
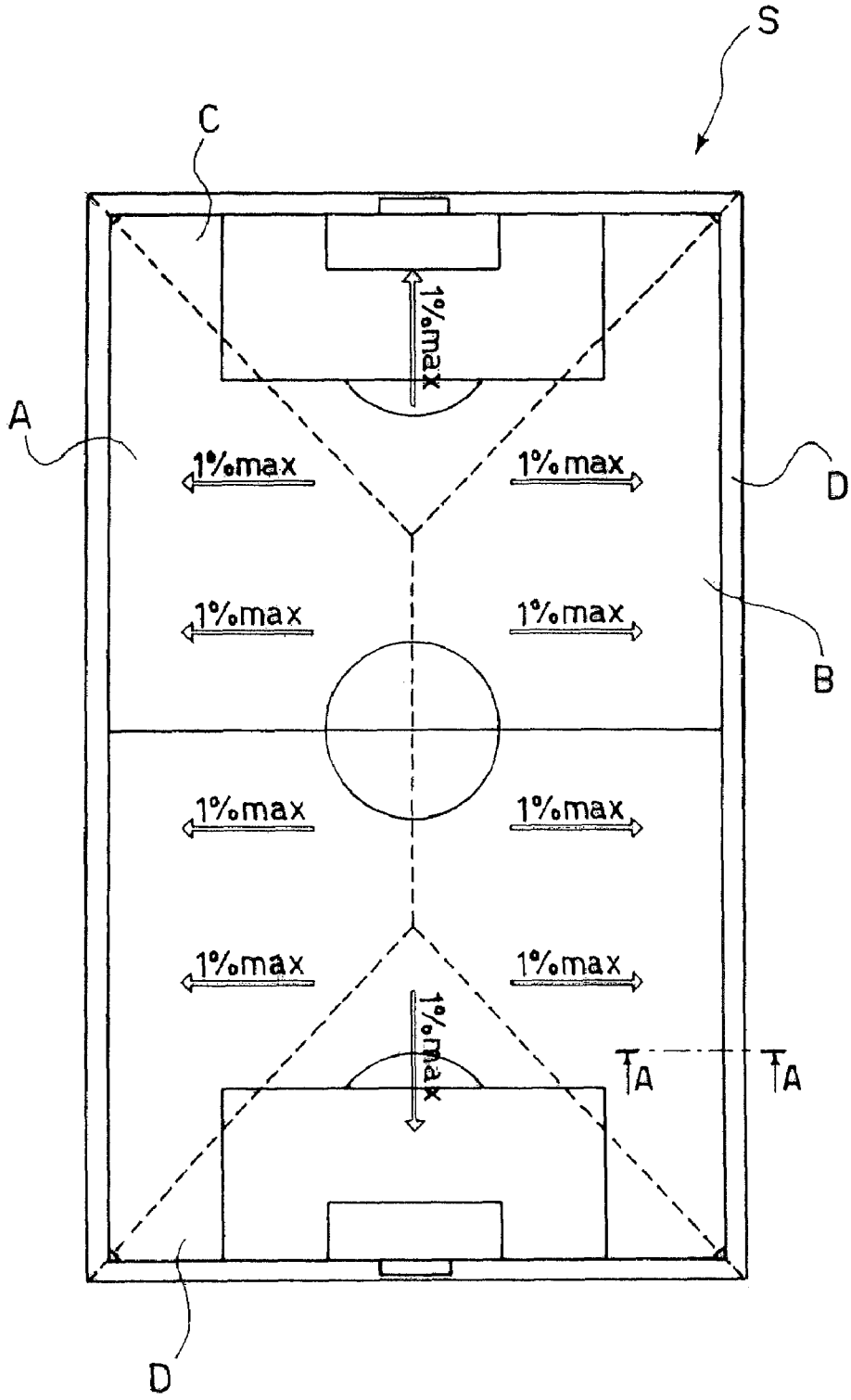
FIG. 1 is a top plan view that illustrates the application of the solution described herein to a sports field such as a football (soccer) pitch.

As mentioned, FIG. 1 is a plan view illustrating the application of the solution described herein to a sports field such as a field S for the game of football (soccer). The reference to the game of football (soccer) of course serves purely to provide a reference, given that the solution described herein may be applied to sports fields of a wide range of types (rugby, five-a-side football, American football, etc.) and, in general to sports facilities such as athletics tracks for running, jumping, etc.

To proceed to laying of the flooring described herein, the field S does not need to be subjected to particular operations, beyond a normal flattening and smoothing carried out so as to bestow upon the field a general profile that is cambered or shaped like pitches of a roof with, in the example illustrated herein, two larger pitches A and B of a trapezial shape and two smaller pitches C and D of a triangular shape, all of which having very gentle inclination (1% maximum, typically 0.5%) degrading towards the outside, to favour draining-off of the waters by gravity.

Along the perimeter of the field S there is then normally provided a gutter covered by a grid to carry away the water.

The laying foundation of the flooring (designated as a whole by 10), is hence constituted by the normal flattened ground 12 preferably arranged on which are a stabilized granular mixed layer 14 with a sand, grit and/or gravel base, typically with a grain size ranging between 0.8 cm and 2.5 cm.

Preferably laid on the layer 14, previously leveled, rolled and compacted using a roller of adequate weight, is a geotextile membrane 16. A preferred choice for the material of the membrane 16 is a non-woven (NW) fabric. This may be a material of the type commonly referred to as continuous-thread non-woven geotextile material, obtained with a processing operation of a needled-felt type. A material of this sort can advantageously be made with a polyester base. The material of the membrane 16 can present, for example, a weight per unit area (according to the UNI EN standard ISO965) of approximately 100 g/m$^2$ to 300 g/m$^2$, typically approximately 150 g/m$^2$.

On the membrane 16, the presence of which, it is emphasized, is not imperative, there is then installed an impermeabilizing sheeting 18 made of polyolefin (for example, polyethylene and/or polypropylene) provided with reliefs that enable running-off of the water. Preferentially, this is a sheeting or impermeabilizing membrane provided with reliefs, in the form of ribbings, embossings or peduncles of various shape (typically peduncles of a cylindrical or approximately cubic shape). Sheets or membranes of this type are in themselves known in the art, as witnessed, for example, by the range of products sold under the trade name of System Platon® and manufactured by the company Isola as of Porsgrunn, Norway.

In the currently preferred embodiment, the material of the membrane or sheeting 16 has a base of polyolefin (in the currently most preferred version, polypropylene) with a thickness of approximately 0.4-0.6 mm.

Set facing upwards, the reliefs of the membrane 16 form between them draining paths that enable running-off of the water even in the presence of heavy rainfall, thus protecting the base of the existing foundation from any possible infiltration and erosion that the flow of water could generate over time, so causing yielding and sagging.

Without any prejudice to said function of draining, in a currently less preferred embodiment of the invention, it is envisaged that:

- instead of having grooving with reliefs—set facing upwards—described previously, the membrane 18 will be smooth; and
- the aforesaid grooving with reliefs—set facing downwards—will be made on the underface of the mattress 1, described in what follows.

The mattress 1, which constitutes the body layer of the flooring 10, is basically a prefabricated elastic mattress of a "fine-tuned" type, made preferentially with the use of material from recycled tires ground, treated and encapsulated so as to be sandwiched between two polyester fabrics.

Specifically, the mattress or, in general, the "material" 1 comprises a core layer 2 (see FIG. 3) constituted by an agglomerate (or conglomerate, the two terms here being used equivalently) of particulate material (i.e., granules). As is known, by "agglomerate material" (or "conglomerate material") is in general meant a material in granular or powder form gathered into a coherent mass or compound.

Agglomerate (or conglomerate) materials of this type, with a base, for example, of granules of elastic polymers, EPDM, and various other types of artificial and synthetic rubbers, and elastomers of various nature, are in themselves known to the art. As agglomeration agent normally bicomponent polyurethane is used or, in more recent applications, monocomponent polyurethane. Materials for floorings which fall within the category described are known to the art, as demonstrated, for example, by the products of the range marketed under the trade name REGUPOL™ and manufactured by the company Berleburger Schaumstoffwerk GmbH (E.U.) or again, by way of example, described in the document No. EP-A-1 555 097.

The above material may be constituted, as has already been said, by material consisting of granules of elastic polymer, rubber of various nature (for example, EPDM) and, in a preferred embodiment, by granular material obtained from recycled tires.

The granular material constituting the core layer 2 is an agglomerate (or conglomerate, the two terms, as has been said, being used herein as equivalent) with the application of a binder constituted, for example, by bicomponent polyurethane or monocomponent polyurethane. As has already been said in the introductory part of the present description, materials of this type are known to the art, a fact that renders any more detailed description herein superfluous.

As regards the binder used for providing the core material 2 with characteristics of agglomerate/conglomerate, it should be recalled that the choice of a binder such as polyurethane, albeit deemed currently preferential, is not in any way imperative. Thus included within the sphere of the present invention is the use of binders of a different type. In a possible variant embodiment of the invention (currently not considered preferred), the state of agglomeration can be achieved by exploiting the characteristics of cohesiveness demonstrated by certain resilient materials (such as certain rubber materials). In this case, it is conceivable to do without the use of binders and to bestow upon the layer 2 the necessary characteristics of mechanical coherence by simply subjecting the granular material to compression.

Just to clarify our ideas (without this implying any limitation of the scope of the invention), the granules constituting the layer 2 can have a grain size in the range of 0.5-7 mm.

of course, the dimensional values indicated previously (as all the other quantitative data provided in the present description and in the ensuing claims) are to be understood as being assigned taking into account the tolerances normally associated to production requirements and to measurement of said quantitative values.

The amount of binder (for example, bicomponent polyurethane or monocomponent polyurethane) used for making the core layer 2 normally lies in the range of approximately 2-10 wt % (with respect to the weight of the granules) in the case of outdoor applications and in the range of approximately 5-15 wt % (referred to the weight of the granules) for indoor applications.

An important characteristic of the solution described herein lies in the fact that the core layer 2 is not "bare", but coated with a membrane or envelope 3 that coats the core layer 2.

For reasons that will emerge more clearly in what follows, the action of coating of the core layer 2 performed by the envelope 3 is complete or substantially complete, in the sense that, in the case where the material 1 is made in the form of strips designed to be wound in rolls, the envelope 3 can envelop the core layer 2 completely, or else leave out one or both of the two terminal ends of the strip.

In the case where the "modules" in which the material 1 is made are in the form of slabs or tiles, for example of a square shape, the envelope 3 can be re-closed (according to the modalities described in greater detail in what follows) in areas corresponding to all the sides of the module, thus performing an action of complete coating (or "encapsulation") of the core layer 2, or else remain open on one side or on two opposite sides.

In the case of modules in the form of slats (i.e., of narrow and long slabs), once again the envelope 3 can have a tubular structure, and hence coat the core layer 2 over the entire development of the module with the exception of the two smaller end sides of the slat. Albeit preserving the aforesaid tubular structure, the envelope 3 can, however, coat the core layer 2 over the entire development of the module with the exception of the two smaller end sides of the slat.

The choice of providing an altogether complete coating or encapsulation or else of leaving uncovered (for example, in view of a possible coating in the course of laying) small fractions of the boundary of the core layer 2 is evidently dictated by the specific conditions of application considered. In any case, the possible presence of small portions of edge of the core layer 2 left uncovered does not alter the global effect of coating of the layer 2 by the envelope 3.

Again, without prejudice to the achievement of the desired effect of envelopment of the core layer 2, according to the geometrical characteristics of the modules that constitute it, the envelope 3 can be made according to different criteria.

For example, two solutions referred to herein for reasons of completeness, but currently not considered preferred, envisage that, in the case where the material 1 is made in the form of a strip, the envelope 3 is made in the form of a single sheet with a continuous tubular structure, fitted around the core layer 2 and fixed to it according to the modalities described in greater detail in what follows, or else constituted by a single originally open sheet that is wound to form a U around the core layer 2 and then closed—usually along one of the longitudinal edges of the strip—so as to provide a tubular structure that envelops the core layer 2.

The figures of the annexed plate of drawings refer to the currently preferred embodiment. In this case, the envelope 3 is constituted by a plurality of sheets (identical to or different from one another), such as, for example, two sheets 3*a* and 3*b* that extend in areas corresponding to the main opposite faces of the core layer 2 and are re-closed along the sides thereof (i.e., along the longitudinal edges of the strip, in the case where the flooring 1 is made in the form of a strip) in areas corresponding to the lines of closing or sealing designated by 4.

In the example illustrated in the figures (again corresponding to the embodiment of the invention that is currently preferred), the two lines of closing 4 are basically coplanar with one of the faces of the core layer 2, so that the sheet 3*a* is substantially plane whilst the sheet 3*b* has a general C-shaped or channel-shaped conformation.

The above choice is not, however, in any way imperative.

Figure 3:
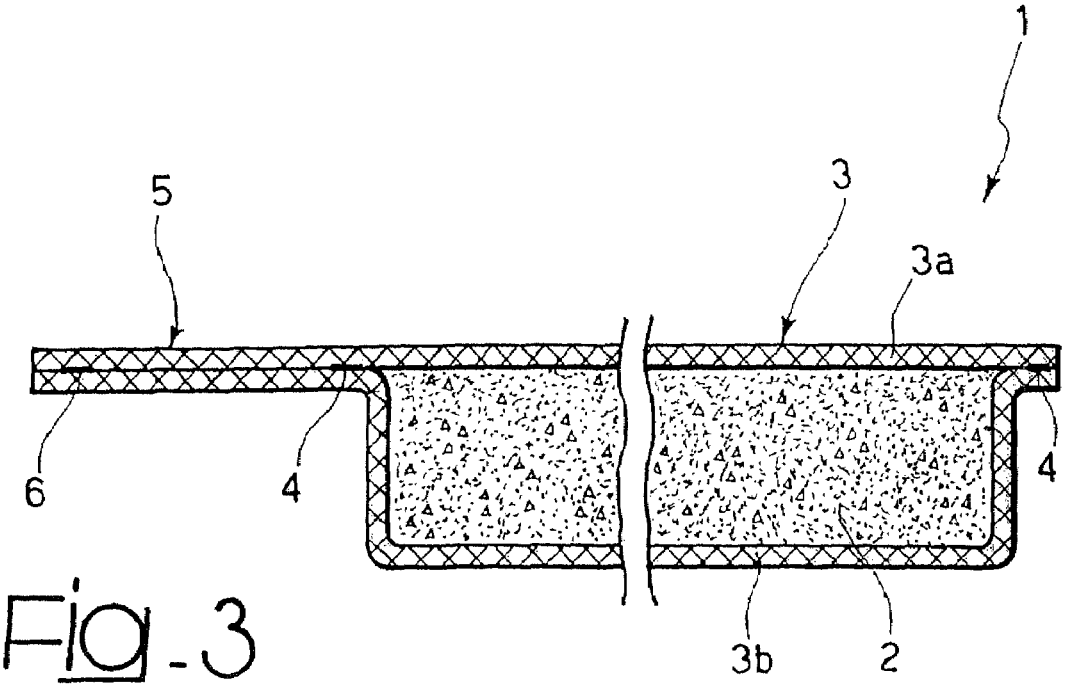
FIG. 3 is a vertical cross-sectional view of one of the layers of the flooring illustrated in FIG. 2.

The lines 4 could in fact be provided, for example, in an area corresponding to an intermediate plane (for example, a middle plane, which is vertical, as viewed in FIG. 3) of the layer 2, or else could be provided, one in an area corresponding to one of the faces of the core layer 2, and the other in an area corresponding to the opposite face of the same core layer 2.

Figure 2:
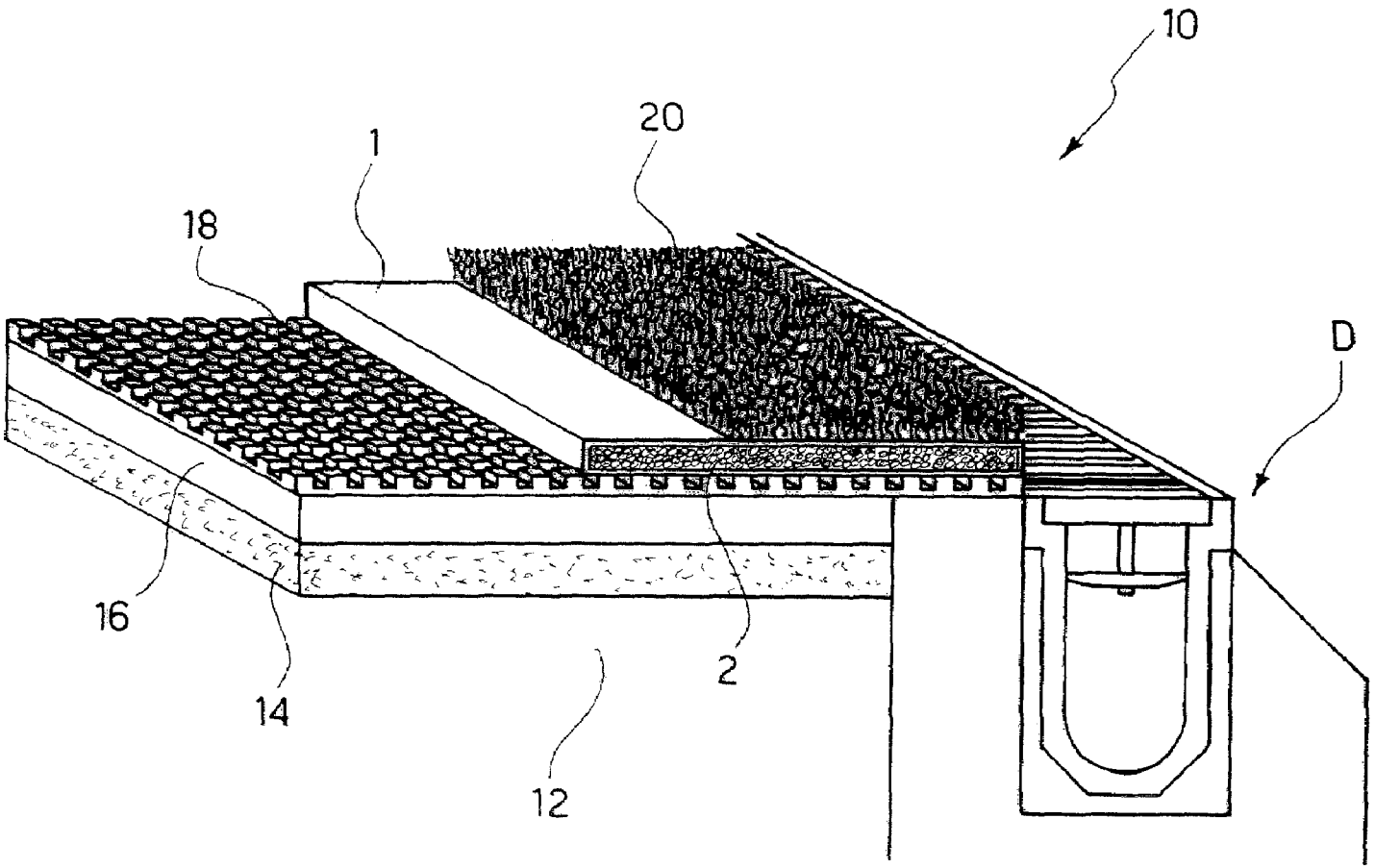
FIG. 2, approximately corresponding to a cross-sectional view according to the line A-A of FIG. 1, reproduced at an enlarged scale, illustrates the structure of the flooring of the type described herein.

In particular, in the embodiment represented in FIG. 2, on one of the sides of the material 1 (but the same solution could be contemplated in areas corresponding to two or more of the sides of each module of material 1), it is envisaged that the sheets 3*a*, 3*b* extend so as to form a selvage 5, usually reinforced, at least in an area corresponding to its distal edge, by at least another line of closing or sealing, designated by 6.

As has already been said, a selvage such as the selvage designated by 5 in FIG. 3 (and designed to enable connection of a number of flooring modules together, according to the criteria described in greater detail in what follows with reference to FIG. 5) can be provided on two or more of the sides of each flooring module 1.

For example, in the case where this module is constituted by a square tile, a selvage such as the selvage 5 can be provided on two adjacent sides of the square.

Again, in the example of embodiment illustrated in FIG. 3 the selvage 5 is represented as formed by an extension of both of the sheets 3*a* and 3*b* of the envelope that coats the core layer 2. However, the selvage 5 could in itself be formed also by only one of these sheets (for example, just by the sheet designated by 3*a*).

A preferred choice for making at least one of the sheets 3*a*, 3*b* of the envelope (i.e., of at least one part of the envelope 3 is constituted by a non-woven (NW) fabric. This may be a material of the type commonly known as continuous-thread non-woven geotextile material, obtained with a process of a needled-felt type. A material of this sort may to advantage be polyester-based.

The material of the envelope 3 can have, for example, a mass per unit area (according to the standard UNI EN ISO965) of approximately 50-400 g/m$^2$, typically approximately 150 g/m$^2$.

The data regarding the mass per unit area provided show that the total mass per unit area of the material 1 is mainly represented by the characteristics of the core layer 2, which is usually far heavier than the envelope 3.

Just to clarify our ideas, materials 1 designed for outdoor applications typically have a thickness of 20-40 mm, preferably in the range of approximately 23-25 mm, with a mass per unit area of approximately 12.5-13.5 kg/m$^2$, hence with a mean distribution of approximately 0.4-0.6 kg/m$^2$ per millimeter of thickness.

The choice, for the envelope 3, of a material of the type described previously is advantageous in so far as the aforesaid material is heat-sealable, and thus enables provision of lines of closing 4 (and 6, if present) via heat sealing with localized application of heat. Alternatives to making said sealing or welding lines are of course represented by the application of glue or by ultrasound welding.

Another important characteristic of the material of the type described above is represented by the fact that, via the joint application of heat and pressure during fabrication of the material or mattress 1 for the flooring 10 (according to the modalities described in greater detail in what follows), it is possible to obtain a firm anchorage of the sheets 3*a* and 3*b* of the envelope 3 on the opposite faces of the core layer 2. The term "firm anchorage" is of course meant to indicate the condition in which the envelope 3 is fixed to the core layer 2 and hence cannot be either removed or made to slide with respect to the core layer 2 unless stresses are applied higher than the ones envisaged in use.

Of course, albeit in a less preferred way, said anchorage can alternatively be achieved with the application of layers of adhesive material.

In any case, the fact that the sheets 3*a*, 3*b* of the membrane are fixed to the core layer 2 (at least as regards the major faces thereof) is important for ensuring the dimensional stability of the mattress 1 and hence of the flooring 10 as a whole.

The materials described previously for making the envelope 3 present the advantage of being able to be made in the form of materials permeable to water, the aim being to bestow upon the material 1 as a whole good characteristics of drainage. Said feature is important for outdoor applications.

The choice of the materials described previously is not, however, in any way imperative and can be changed according to specific needs of application.

In particular, different parts of the envelope 3 (for example, the sheets 3*a* and 3*b* visible in FIG. 3 can be made with different materials.

The possible criteria of fabrication of a material for floorings, such as the material 1, are described in detail in the European patent application No. 05425663.1, filed in the name of the present applicant.

Figure 4:
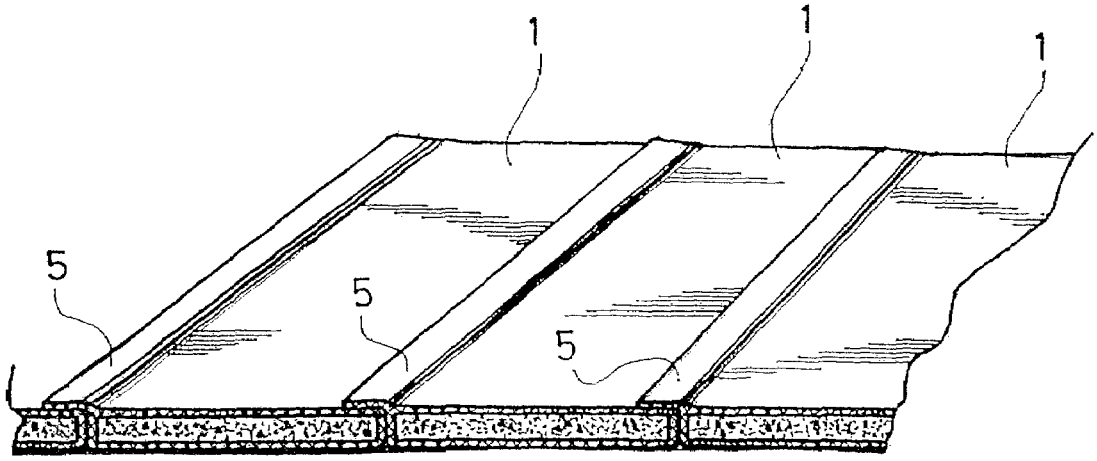
FIG. 4 is a schematic illustration of the method of laying of the layer of flooring illustrated in FIG. 3.

FIG. 4 is a schematic illustration of the operation of laying of the material 1 described herein, with specific reference to the case where this is made in the form of strips. Extension to the case where the material is made in the form of tiles is evident and hence does not require any detailed illustration in the present context.

Basically, the strips of material 1 are unrolled and laid on the foundation (here equated for reasons of simplicity with the field S, but formed in the case in point by the membrane 18) alongside one another in such a way as to cause the selvage 5 present on one side of each strip to be placed in a relationship of overlapping at the side (which is usually without any selvage) provided in the adjacent strip/module.

The selvages 5 that are thus in a relationship of overlapping are then fixed (for example, by gluing or heat sealing) each on the adjacent strip 1, thus giving rise to a continuous structure such as to present, precisely as a result of the sealing along the selvages 5, excellent characteristics of resistance and mechanical stability as a whole. Thanks to this stability, the material 1 described herein is suited for being laid on a foundation S even without needing to be connected thereto in an adhesive relationship.

According to the needs of application, the laying solution according to which the selvage 5 present on one side of a strip/module is placed in a relationship of overlapping at one side (which is usually without selvage) of the adjacent strip/module can be performed also in a condition that is turned over with respect to the conditions illustrated by way of example in FIG. 4.

FIG. 4 in fact illustrates a laying condition in which the various flooring strips are laid on the foundation S with an orientation like the one illustrated in FIG. 3, i.e., with the selvages 5 substantially aligned with the sheet 3*a* and hence with the upper face of the material 1. In this case, the selvage 5 present on one side of each strip overlaps the top side of the adjacent strip/module; i.e., it is set on top of said adjacent strip/module. The selvages 5 extend therefore on the top side of the flooring that has been laid, at a distance from the foundation S substantially equal to the thickness of the material 1, so that they remain in sight.

In the turned-over laying condition mentioned previously, the various strips of flooring are laid on the foundation S with an orientation such as the one illustrated in FIG. 4, i.e., with the selvages 5 substantially aligned with the sheet 3*a*, which in this case, however, defines the underface of the material 1, facing the foundation S. By adopting this laying condition, the selvage 5 present on one side of each strip overlaps the underside of the adjacent strip/module, i.e., the face underneath said adjacent strip/module. In this case, the selvages 5 extend on the underside of the flooring that is laid, in contact with the foundation S and hence hidden from sight by the flooring 10 itself.

The prefabricated elastic mattress 1 described herein, having preferentially a thickness of approximately of 28 mm, is configured as a mattress of a "fine-tuned" type, i.e., optimized in relation to the best technical features and characteristics of performance for the absorption of any impact and for return of energy.

The prefabricated elastic mattress 1 is made preferentially starting from recycled tires, ground, treated, and encapsulated so that the material thus obtained is sandwiched between two polyester fabrics.

In the preferred solution, the core layer 2 is made with a fraction of between 60% and 80%, typically approximately 70% of resilient granules (granules of recycled tires) and with a fraction of between 20% and 40%, typically approximately 30% of plastic granules (polyolefins or granulated plastic materials deriving from differentiated collection).

This composition enables an optimal response to be obtained as regards absorption of energy, vertical deformation, and return of energy.

It should once again be recalled what has already been said previously as regards description of the membrane 18, namely, that, in one, currently less preferred, embodiment of the invention, the grooving with reliefs—set facing upwards—provided in the membrane 18 can be replaced by grooving with reliefs—set facing downwards—made on the bottom face of the mattress 1.

Finally, a synthetic-grass covering 20 is laid on the mattress 1.

Said synthetic-grass covering, which has, for instance, a thickness of 40 mm, comprises a sheetlike substrate with a plurality of filiform formations extending from the substrate to simulate the grassy sward of natural turf, and a particulate filling material or infill dispersed between said filiform formations so as to maintain the filiform formations themselves in a substantially upright condition.

In the case where the layer of synthetic grass described in U.S. Pat. No. 6,877,535 (which corresponds to EP-A-1 158 099) is, for example, adopted, the aforesaid particulate filling material or infill is constituted by a substantially homogeneous mass of a granular material chosen from the group constituted by polyolefin-based materials and by vinyl-polymer-based materials.

Said filling material is preferentially a particulate infill with a polyethylene-based material and/or a material with a base of recycled polyolefins, or else a PVC-based material and/or a material with a base of recycled vinyl polymers.

From the foregoing, it may be appreciated that the solution described herein enables provision of a flooring which can be applied and installed with minimal costs and in a very short time. It can be used for soccer pitches and five-a-side football pitches but also for other sports, such as American football, rugby, golf etc. It is able to guarantee uniformity of characteristics and of performance irrespective of the weather conditions in which it is used. It can also be used on those grounds provided with heating of the underlying foundation, as well as in extreme climatic conditions.

The "flooring system" thus made can be dismantled and if necessary be removed and replaced as regards the top part. In fact, the "fine-tuned" elastic mattress 1 presents a very high durability, whereas the synthetic-grass covering 20 may undergo wear and after a certain number of years require replacement. It can thus be removed and replaced. The "old" grass cover that is replaced is totally recyclable (thus preventing burdensome costs for dismantling and disposal) and may possibly be reused to produce a new synthetic-grass covering.

It will be appreciated that, even when it is not expressly stated using by expressions such as "approximately" or "in the region of", all of the numerical values of physical quantities referred to herein are to be interpreted taking into account the tolerances normally associated to the determination and measurement of said quantities.

of course, without prejudice to the principle of the invention, the details of fabrication and the embodiments may vary widely with respect to what is described and illustrated herein purely by way of example, without thereby departing from the scope of the invention, as defined by the annexed claims.

The invention claimed is:

1. A flooring comprising:

a polyolefin-based impermeable layer;

an elastic mattress laid on top of said impermeable layer and comprising a core layer, said core layer comprising an agglomerate granular material and an envelope that envelops said core layer; and a structure comprising a synthetic-grass covering laid on top of said elastic mattress and comprising a sheetlike substrate with a plurality of filiform formations extending from the substrate to simulate the grassy sward of natural turf, and a particulate filling material or infill dispersed between said filiform formations to maintain the filiform formations in a substantially upright condition.

2. The flooring according to claim 1, further comprising a geotextile membrane laid underneath said impermeable layer.

3. The flooring according to claim 2, wherein said geotextile membrane comprises non-woven (NW) fabric, such as a continuous-thread non-woven geotextile material.

4. The flooring according to claim 2 wherein said geotextile membrane is polyester-based.

5. The flooring according to claim 2 wherein said geotextile membrane has a weight per unit area of approximately 100-300 g/m$^2$.

6. The flooring according to claim 1 wherein said impermeable layer is polypropylene-based.

7. The flooring according to claim 1 wherein said impermeable layer has a thickness of approximately 0.4-0.6 mm.

8. The flooring according to claim 1 further comprising reliefs to facilitate draining provided between said impermeable layer (18) and said mattress.

9. The flooring according to claim 8, wherein said reliefs to facilitate draining are in the form of at least one of ribbings, embossings and peduncles.

10. The flooring according to claim 8 wherein said reliefs to facilitate draining are carried by said impermeable layer and are set facing upwards.

11. The flooring according to claim 8 wherein said reliefs to facilitate draining are carried by said mattress and are set facing downwards.

12. The flooring according to claim 1 wherein said mattress has a thickness of approximately 20-40 mm.

13. The flooring according to claim 1 wherein said mattress has a weight per unit area of approximately 12.5-13.5 kg/m$^2$.

14. The flooring according to claim 1 wherein said mattress has a mean weight per unit area of approximately 0.4-0.6 kg/m$^2$ per millimeter of thickness.

15. The flooring according to claim 1 wherein said agglomerate granular material comprises a mixture of resilient granules and of plastic granules.

16. The flooring according to claim 15, wherein said agglomerate granular material comprises a fraction of between 60% and 80% of resilient granules and a fraction of between 20% and 40% of plastic granules.

17. The flooring according to claim 15 wherein said resilient granules are granules obtained from recycled tires.

18. The flooring according to claim 15 wherein said plastic granules are granules obtained from material chosen from between polyolefins and granulated plastic materials deriving from differentiated collection.

19. The flooring according to claim 1 wherein said mattress is in the form of a strip or slat with two terminal ends and said envelope coats said strip or slat with the exception of said terminal ends.

20. The flooring according to claim 1 wherein said mattress is in the form of modules and said envelope forms, on at least one side of said modules, a selvage which can be arranged so that it is in a relationship of overlapping with at least one adjacent module.

21. The flooring according to claim 1 wherein said envelope is fixed with respect to said core layer.

22. The flooring according to claim 1 wherein said envelope is formed by a single sheet.

23. The flooring according to claim 1 wherein said envelope is permeable to liquids, so that said mattress comprises draining characteristics.

24. The flooring according to claim 1 wherein said envelope is made of heat-sealable material.

25. The flooring according to claim 1 wherein said envelope comprises a non-woven fabric.

26. The flooring according to claim 3 wherein said non-woven fabric is formed of a continuous-thread needled-geotextile type.

27. The flooring according to claim 1 wherein said envelope has a weight per unit area of approximately 50-400 g/m$^2$.

28. The flooring according to claim 1 wherein said envelope is polyester-based.

29. The flooring according to claim 1 wherein said core layer comprises granular material with a grain size in the range of approximately 0.5-7 mm.

30. The flooring according to claim 1 wherein said granular material is chosen from the group consisting of elastic polymers, elastomers, rubbers, and recycled resilient materials.

31. The flooring according to claim 1 wherein said granular material comprises granular material obtained from recycled tires.

32. The flooring according to claim 1 wherein said granular material is agglomerated by means of a binder.

33. The flooring according to claim 32 wherein said binder is polyurethane.

34. The flooring according to claim 32 wherein said binder is present in a percentage in the range of approximately 2-10 wt %, referring to the weight of the granules.

35. The flooring according to claim 32 wherein said binder is present in a percentage in the range of approximately 5-15 wt %, referring to the weight of the granules.

36. The flooring according to claim 1 wherein said particulate filling material or infill comprises a substantially homogeneous mass of a granular material chosen from the group consisting of polyolefin-based materials and vinyl-polymer-based materials.

37. The flooring according to claim 1 wherein said particulate filling material or infill comprises a mixture of sand and of granular material chosen from the group consisting of polyolefin-based materials and vinyl-polymer-based materials.

38. A method for laying a flooring according to claim 1, the method comprising:

smoothing the laying foundation; and laying the flooring directly on the flattened laying foundation.

39. The method according to claim 38, further comprising including in the flattened laying foundation a stabilized granular mixed layer.

40. The method according to claim 38 further comprising smoothing the laying foundation (S) bestowing upon it a camber to facilitate draining.

41. A method for laying a flooring according to claim 20, the method comprising:

superimposing said elastic mattress on said impermeable layer, laying in position alongside one another at least one first module and one second module of said material;

arranging the selvage carried by one of said modules in a relationship of overlapping with the other of said modules; and fixing said selvage to the other of said modules.

42. The method according to claim 41, further comprising arranging the selvage carried by one of said modules in a relationship of superposition so that it overlaps the other of said modules.

43. The method according to claim 41, further comprising arranging the selvage carried by one of said modules in a relationship of superposition so that it is overlapped by the other of said modules.

* * * * *